US007774897B2

(12) United States Patent
Oh et al.

(10) Patent No.: US 7,774,897 B2
(45) **Date of Patent: *Aug. 17, 2010**

(54) VACUUM CLEANER HAVING APPARATUS FOR GIVING OFF FRAGRANT ODOR

(75) Inventors: Jang-Keun Oh, Gwangju (KR); Seung-Yong Cha, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 260 days.

This patent is subject to a terminal disclaimer.

(21) Appl. No.: 11/974,273

(22) Filed: Oct. 12, 2007

(65) Prior Publication Data

US 2009/0260178 A1 Oct. 22, 2009

(30) Foreign Application Priority Data

Apr. 25, 2007 (KR) ..... 10-2007-0040274

(51) Int. Cl.
*A47L 9/12* (2006.01)

(52) U.S. Cl. ..... 15/327.2; 15/339; 96/222

(58) Field of Classification Search ..... 15/327.2, 15/339; 96/222; 422/124; 239/55–57, 60; 261/30, 35, DIG. 65, DIG. 88; *A47I 7/04; A47L 9/00, A47L 9/12*

See application file for complete search history.

(56) References Cited

U.S. PATENT DOCUMENTS 1,521,872 A 1/1925 Dellinger
1,891,256 A * 12/1932 Bilde ..... 96/222
1,954,924 A 4/1934 Engberg et al.
2,248,610 A * 7/1941 Clements ..... 15/246
3,371,985 A 3/1968 Wyka
5,185,903 A 2/1993 Choi
5,368,822 A * 11/1994 McNeil ..... 422/124
5,967,412 A 10/1999 Lee
6,165,419 A * 12/2000 Bullock et al. ..... 422/124

(Continued)

FOREIGN PATENT DOCUMENTS

DE 4204553 8/1993

(Continued)

OTHER PUBLICATIONS

Extended European Search Report for corresponding European Patent Application No. 07291551.5 dated Sep. 24, 2009.

(Continued)

*Primary Examiner*—David A Redding
(74) *Attorney, Agent, or Firm*—Ohlandt, Greeley, Ruggiero & Perle, LLP

(57) ABSTRACT

The vacuum cleaner that includes a fragrant odor generating apparatus is provided. The fragrant odor generating apparatus is mounted to a discharge port of a grill member housed in a main cleaner body, to discharge an air freshener to an air being discharged through the discharge port after air containing dust is drawn in from a surface being cleaned and dust is separated from the drawn-in air. The fragrant odor generating apparatus includes a housing comprising a first air passing hole in fluid communication with the discharge port, and a second air passing hole in fluid communication with outside, an outer cover member pivotably mounted to the housing to selectively open and close the second air passing hole, and the air freshener containing a fragrant agent.

16 Claims, 5 Drawing Sheets

U.S. PATENT DOCUMENTS

| | | | | |
|---|---|---|---|---|
| 6,171,375 | B1 * | 1/2001 | Howie | 96/17 |
| 6,174,350 | B1 * | 1/2001 | Rohn et al. | 95/218 |
| 6,231,647 | B1 * | 5/2001 | Cheng | 96/226 |
| 6,511,548 | B1 * | 1/2003 | Oreck et al. | 134/21 |
| 7,093,773 | B2 * | 8/2006 | Kuiper | 239/57 |
| 2005/0138763 | A1 | 6/2005 | Tanner et al. | |
| 2007/0209144 | A1 | 9/2007 | Fester et al. | |
| 2007/0209147 | A1 | 9/2007 | Krebs et al. | |
| 2008/0010958 | A1 | 1/2008 | Fester et al. | |
| 2008/0047091 | A1 | 2/2008 | Nguyen | |

FOREIGN PATENT DOCUMENTS

| | | |
|---|---|---|
| EP | 1561477 | 8/2005 |
| GB | 2454293 | 5/2009 |
| KR | 1992-0008680 | 12/1992 |
| KR | 1999-0028949 | 7/1999 |
| KR | 20-0201796 | 11/2000 |

OTHER PUBLICATIONS

Combined Search and Examination Report dated Dec. 12, 2008 corresponding to British Application No. GB0815003.9.

* cited by examiner

VACUUM CLEANER HAVING APPARATUS FOR GIVING OFF FRAGRANT ODOR

CROSS-REFERENCE TO RELATED APPLICATIONS

This application claims priority from Korean Patent Application No. 10-2007-40274 filed on Apr. 25, 2007 in the Korean Intellectual Property Office, the entire disclosure of which is incorporated herein by reference.

BACKGROUND OF THE INVENTION

1. Field of the Invention

The present disclosure relates to a vacuum cleaner, and more particularly, to a vacuum cleaner having an apparatus for giving off a fragrant odor.

2. Description of the Related Art

A general vacuum cleaner draws in dust-laden air from outside, while keeping a nozzle assembly in contact with a surface being cleaned. The drawn air is introduced into a dust separating apparatus housed in the vacuum cleaner, and dust is separated from the air. The clean air is discharged outside the vacuum cleaner body.

While general vacuum cleaners are efficient to clean the air containing dust or contaminant on the surface being cleaned, few destroy bad smells effectively. Therefore, a user conventionally opens the doors or windows to get fresh air into the space being cleaned. If a user wishes to add pleasant odor to a room, he needs to purchase an air freshener separately, and even if he does, it was cumbersome for the user as he has to walk to different places of the room, spraying the air freshener.

Many attempts were made to resolve above mentioned inconvenience, including "Discharge port of a vacuum cleaner" disclosed in Korean Utility Model Publication No. 20-0201796. The discharge port of KR20-0201796 mainly includes a discharge port body connected with a discharge pipe of a motor and rotatable on one side of a cleaner main body, a discharge plate rotatably mounted on the discharge port body, and a receptacle engaged with the discharge plate and which accommodates an air freshener therein. However, the above structure has a shortcoming in that substance of the air freshener is blown away in the discharged air from the vacuum cleaner. Even when the vacuum cleaner is not in use, because the substance of the air freshener in the receptacle is apt to dissipate to the air through the discharge plate, replacement is required frequently.

Korean Utility Model Publication No. 10-1999-028949 disclosed an air freshener, which gives off fragrant odor when it is heated by the discharge heat. This solves the problem of the related art of frequent replacement of air freshener because the freshener does not dissipate when the motor is not driven. However, the air freshener dissipates when the vacuum cleaner is stowed in a hot place, or exposed to the sunlight. If the air freshener is used up, it is cumbersome for a user to replace it, because the air freshener is generally placed inside the vacuum cleaner body.

Korean Utility Model Publication No. 20-1992-0008680 discloses a vacuum cleaner in which electricity is periodically supplied to a coil according to the driving of the cleaner, and an air path is open by the electricity to allow odor of air freshener to be supplied therethrough. However, this structure requires an increased number of components, and takes space.

SUMMARY OF THE INVENTION

The present disclosure provides a vacuum cleaner having an improved structure of giving off fragrant odor, in which fragrant substance of an air freshener is selectively discharged to outside according to whether or not air is discharged from the vacuum cleaner such that the air freshener is used for a longer period of time and does not require frequent replacement.

According to an aspect of the present disclosure, there is provided a vacuum cleaner which includes a fragrant odor generating apparatus mounted to a discharge port of a grill member housed in a main cleaner body, to discharge an air freshener to an air being discharged through the discharge port after air containing dust is drawn in from a surface being cleaned and dust is separated from the drawn-in air. The fragrant odor generating apparatus includes a housing comprising a first air passing hole in fluid communication with the discharge port, and a second air passing hole in fluid communication with outside, an outer cover member pivotably mounted to the housing to selectively open and close the second air passing hole, and the air freshener containing a fragrant agent, and mounted inside the housing. If the vacuum cleaner is driven and air is discharged through the discharge port, the discharged air past through the discharge port and the first air passing hole pushes the outer cover member to a direction of opening the second air passing hole, so that the discharged air containing the fragrant agent is passed through the second air passing hole and discharged to outside, and if the vacuum cleaner is not driven and air is not discharged through the discharge port, the outer cover member is moved to a direction of closing the second air passing hole by its own weight.

The fragrant odor generating apparatus may further include an inner cover member pivotably mounted on the housing to selectively open and close the first air passing hole, so that if the vacuum cleaner is driven and air is discharged through the discharge port, the discharged air causes the inner cover member to pivot to a direction of opening the first air passing hole. If the vacuum cleaner is not driven and air is not discharged through the discharge port, the inner cover member is moved by its own weight to a direction of closing the first air passing hole.

The vacuum cleaner may further include a first elastic member to elastically bias the inner cover member to a direction of closing the first air passing hole, and a second elastic member to elastically bias the outer cover member to a direction of closing the second air passing hole. The inner cover member and the outer cover member are pivoted by the force of the air discharged through the discharge port, to open the first and second air passing holes. If the vacuum cleaner stops operation and air is not discharged through the discharge port any more, the inner cover member and the outer cover member are pivoted by the first and second elastic members to a direction of closing the first and second air passing holes.

The housing may include a main housing body having one side open, the air freshener removably mounted therein, and a plurality of engagement holes formed therein; and a housing cover having a plurality of engagement projections corresponding to the plurality of engagement holes, the housing cover being engaged by interlocking of the plurality of engagement projections and the plurality of engagement holes to cover the open side of the main housing body.

The housing may include a main housing body having one side open, and the air freshener removably mounted inside the main housing body, and a housing cover pivotably mounted to the main housing body, to selectively open and close the open side of the main housing body.

The outer cover member may be mounted to an upper surface of the main housing body.

The outer cover member may be mounted to a side surface of the main housing body.

The outer cover member may be mounted to the housing cover.

BRIEF DESCRIPTION OF THE DRAWINGS

The above and/or other aspects of the present disclosure will become apparent and more readily appreciated from the following description of the exemplary embodiments, taken in conjunction with the accompanying drawings of which.

DETAILED DESCRIPTION OF EXEMPLARY EMBODIMENTS OF THE INVENTION

Figure 1:
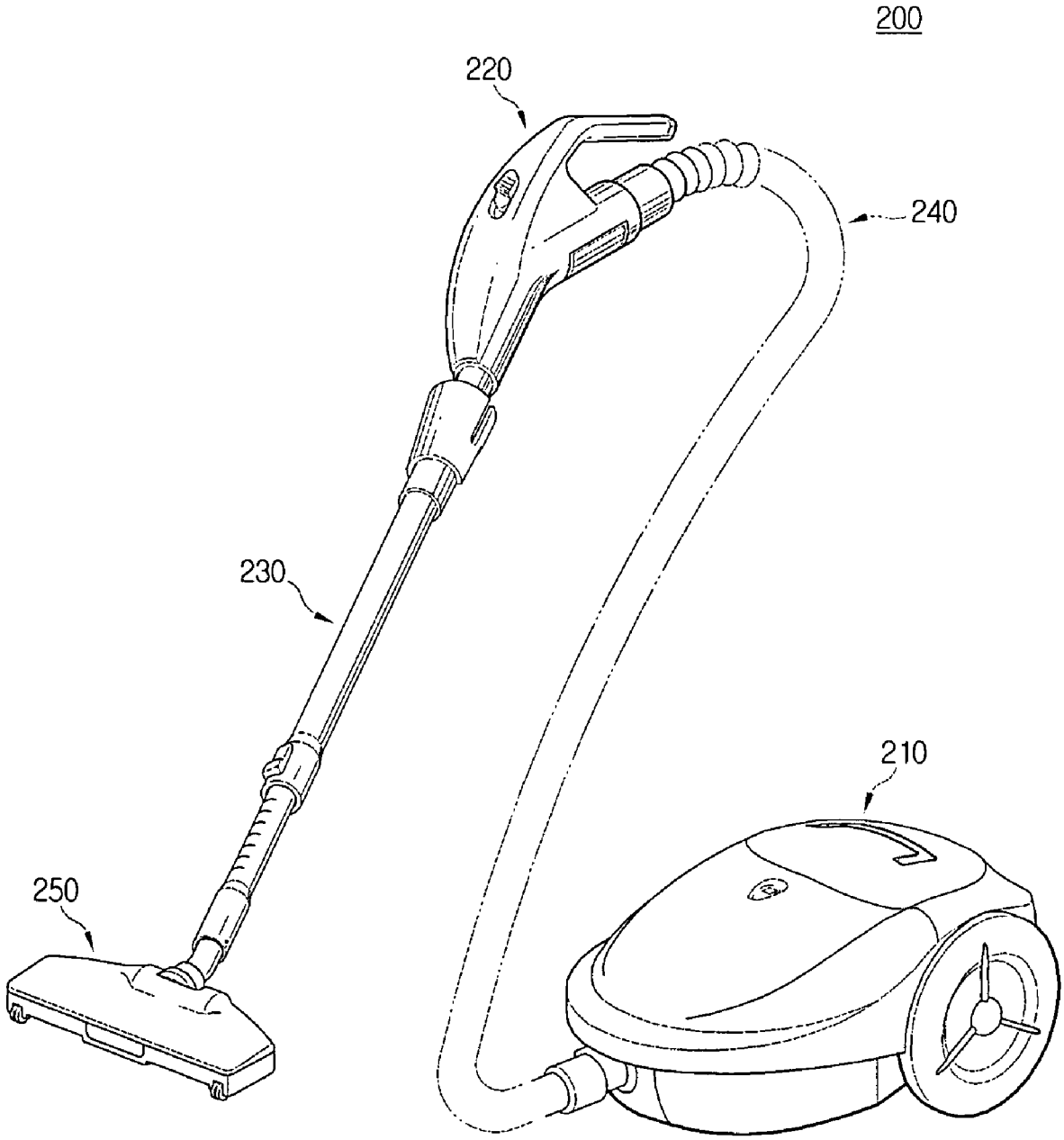
FIG. 1 is a perspective view of a vacuum cleaner having an apparatus for giving off fragrant odor according to an exemplary embodiment of the present disclosure.

Reference will now be made in detail to the exemplary embodiments of the present disclosure, examples of which are illustrated in the accompanying drawings, wherein like reference numerals refer to the like elements throughout. The exemplary embodiments are described below to explain the present disclosure by referring to the figures.

Figure 2:
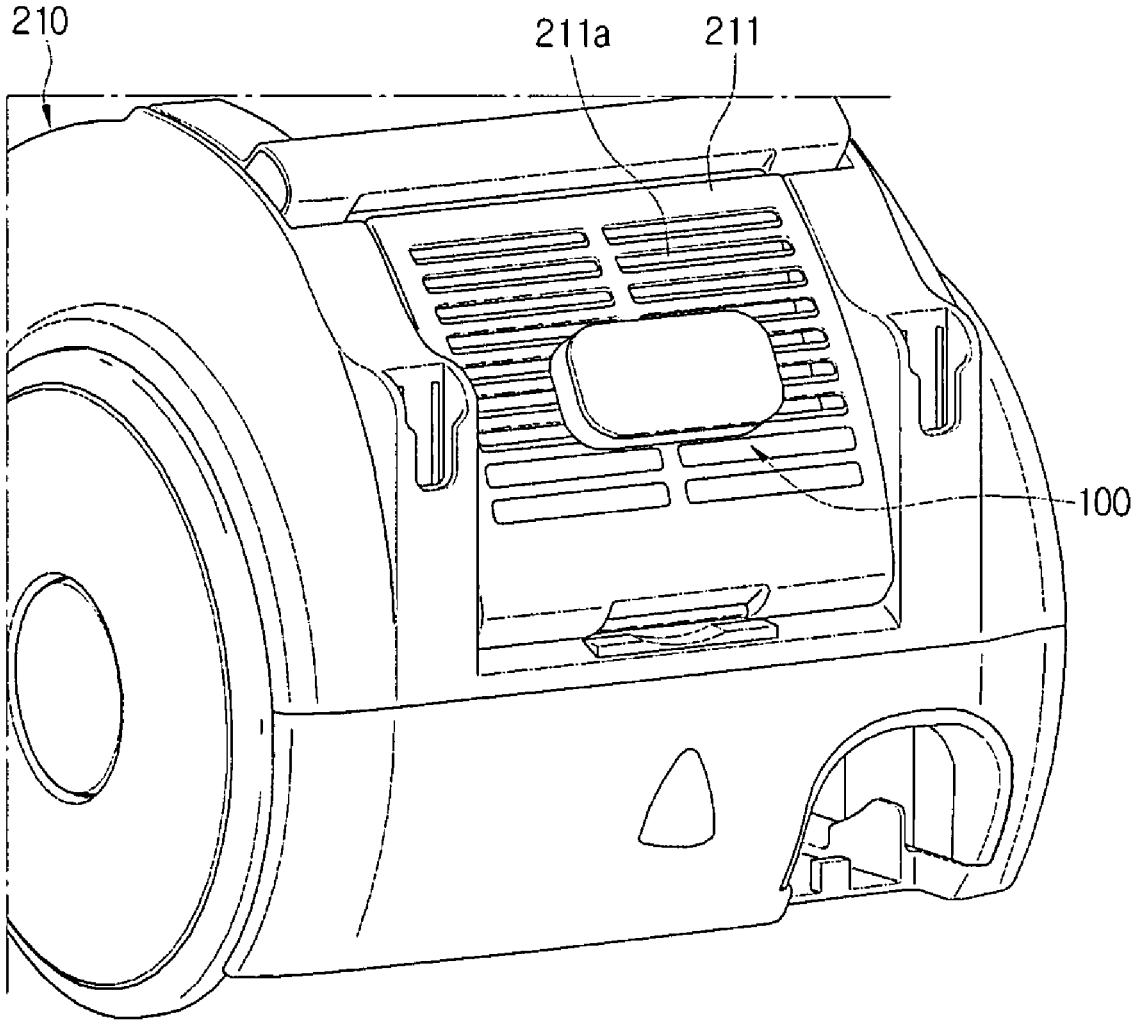
FIG. 2 illustrates a rear view of the main body of the vacuum cleaner of FIG. 1.

Referring to FIGS. 1 and 2, a vacuum cleaner 200 according to an exemplary embodiment of the present disclosure includes a main cleaner body 210, a handle part 220, an extension pipe 230, a flexible hose 240, a nozzle assembly 250, and a fragrant odor generating apparatus 100. The vacuum cleaner in the following exemplary embodiment of the present disclosure may have the generally-known structure except for employing the fragrant odor generating apparatus 100, and therefore, may have the substantially similar structures of the main cleaner body 210, the handle part 220, the extension pipe 230, the flexible hose 240, and the nozzle assembly 250 as the general ones. Hereinbelow, the fragrant odor generating apparatus 100 according to an exemplary embodiment of the present disclosure will be explained in detail.

The main cleaner body 210 houses a vacuum motor (not shown) to provide suction source, a dust separating apparatus (not shown) to separate dust from an externally drawn dust-containing air, and a grill member 211 to discharge air after the air is separated from the dust. The clean air is discharged through a discharge port 211*a* formed in the grill member 211.

The handle part 220 is disposed between the main cleaner body 210 and the nozzle assembly 250. The handle part 220 may be configured for an easy grip of a user.

The extension pipe 230 connects the nozzle assembly 250 with the handle part 220. The flexible hose 240 connects the handle part 220 with the main cleaner body 210.

The nozzle assembly 250 includes a suction port (not shown) formed in a bottom surface to draw in dust-containing air from a surface being cleaned. The nozzle assembly 250 is connected with the extension pipe 230 in fluid communication, so that the dust-containing air drawn through the suction port (not shown) is introduced into the extension pipe 230.

Figure 3:
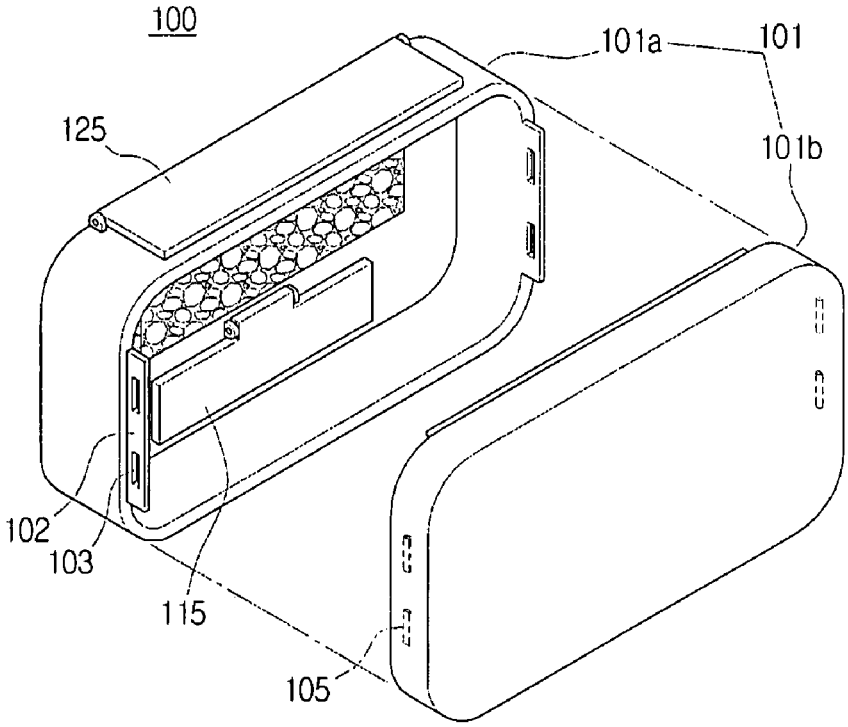
FIG. 3 is a perspective view of the apparatus for giving off fragrant odor of FIG. 1.
Figure 4A:
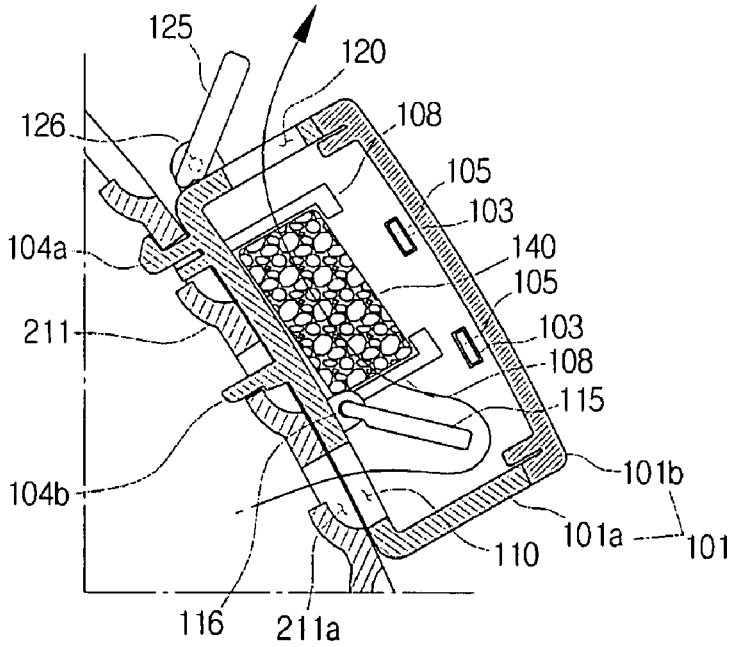
FIG. 4A is a sectional view illustrating an apparatus for giving off fragrant odor while a vacuum cleaner is in operation.
Figure 4B:
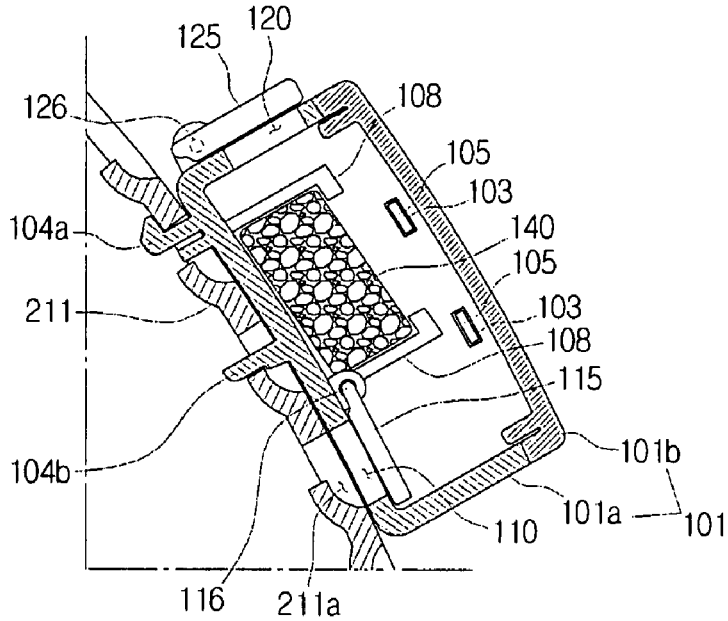
FIG. 4B is a sectional view illustrating an apparatus for giving off fragrant odor while a vacuum cleaner is not in operation.

Referring to FIGS. 3, 4A and 4B, the fragrant odor generating apparatus 100 according to an exemplary embodiment of the present disclosure includes a housing 101, an inner cover member 115, an outer cover member 125, and an air freshener 140.

The housing 101 includes a main housing body 101*a* and a housing cover 101*b*.

The main housing body 101*a* may have the configuration of a box having one side open. The housing body 101*a* may include a hooking projection 104*a* and an extension projection 104*b* on a side opposite to the open side, to detachably engage with the discharge port 211*a* of the grill member 211. In this case, the main housing body 101*a* may be detachably mounted on an outer side of the grill member 211. The main housing body 101*a* may include a first air passing hole 110 in fluid communication with the discharge port 211*a* of the grill member 211, and a second air passing hole 120 to connect interior of the housing 101 with the exterior so that the air introduced into the housing 101 through the discharge port 211*a* and the first air passing hole 110 is discharged to the outside. The main housing body 101*a* may include a mount rib 108 therein, to mount the air freshener 140 thereon, and extension parts 102 formed opposite to each other at an open side of the main housing body 101*a* to engage with the housing cover 101*b*.

The housing cover 101*b* covers the open side of the main housing body 101*a*, to form a path for the air past the discharge port 211*a* and the first air passing hole 110 to pass the second air passing hole 120, and discharged to the outside. The housing cover 101*b* includes an engagement projection 105 corresponding to an engagement hole 103 of the main housing body 101*a*. The engagement projection 105 may be configured in a substantially rectangular shape.

The inner cover member 115 may be disposed on one inner side of the main housing body 101*a* to selectively open the first air passing hole 110. The inner cover member 115 may be pivoted about a first hinge 116. As the vacuum cleaner is driven, air is discharged through the discharge port 211*a*. As the discharged air reaches the first air passing hole 110 which is in fluid communication with the discharge port 211*a*, the inner cover member 115 is pivoted about the first hinge 116 by the flow of the discharged air, to open the first air passing hole 110. Accordingly, the discharged air enters the housing 101. If the vacuum cleaner is stopped and air is not discharged from the discharge port 211*a* any more, the inner cover member 115 is pivoted about the first hinge 116 by its own weight, to close the first air passing hole 110.

The outer cover member 215 is pivotable about a second hinge 126, and mounted on the outer surface of the upper portion of the main housing body 101*a*, to selectively open the second air passing hole 120. As vacuum cleaner is driven, air is discharged through the discharge port 211*a*, passes through the first air passing hole 110, passes through the interior of the housing 101, and reaches the outer cover member 125. The discharged air pushes the outer cover member 125, causing the outer cover member 125 to pivot about the second hinge 126 and open the second air passing hole 120. Accordingly, air inside the housing 101 is discharged out through the second air passing hole 120. If vacuum cleaner stops and thus air is not discharged from the discharge port 211*a* any more, the outer cover member 125 is pivoted about the second hinge 126 by its own weight, to close the second air passing 120.

The air freshener 140 may be volatile to allow fragrant odor to dissipate to the air. The air freshener 140 may be removably mounted on the mount rib 108 provided at the main housing body 101*a*. The air freshener 140 may further include functional properties such as pytoncide, anti-allergy agent, or disinfectant. The air freshener 140 may be implemented as a tea-bag like device that is placed in the mount rib 108. A user may grab and open the housing cover 101*b* from the main housing body 101*a* with ease. Accordingly, it is easy to replace the air freshener 140 from the mount rib 108.

The above exemplary embodiment describes that the air freshener 140 is mounted to the mount rib 108, but it should not be construed as limiting. Alternatively, the air freshener 140 may be placed within the housing 101 and secured by tape.

The operation of the vacuum cleaner 200 having the fragrant odor generating apparatus 100 according to an exemplary embodiment of the present disclosure will be explained in detail below, with reference to FIGS. 1, 4A and 4B.

FIG. 4A illustrates the fragrant odor generating apparatus 100 in a state that the vacuum cleaner is in operation and that the air is discharged through the discharge port 211*a*, and FIG. 4B illustrates the fragrant odor generating apparatus 100 in a state that the vacuum cleaner is not in operation and that the air is not discharged through the discharge port 211*a*.

First, as a user starts driving the vacuum cleaner, air is drawn in through the nozzle assembly 250, and passed through the extension pipe 230, the handle part 220, and the flexible hose 240, in sequence. Accordingly, air is introduced into the dust separating apparatus (not shown) mounted within the main cleaner body 210, so that dust is separated from the drawn-in air. After the dust separation, clean air is discharged through the discharge port 211*a* formed in the discharge grill 211 of the main cleaner body 210. As a result, clean air is discharged back into the place being cleaned. Referring to FIG. 4A, some of the air being discharged through the discharge port 211*a* flows to the first air passing hole 110 in fluid communication with the discharge port 211*a*, causing the inner cover member 115 to pivot about the first hinge 116 and open the first air passing hole 110. Accordingly, the discharged air is introduced into the housing 101 through the first air passing hole 110. The air introduced into the housing 101 mixes with the fragrant agent dissipating from the air freshener 140. Therefore, air including fragrant agent flows to the second air passing hole 120, pushes the outer cover member 125 to pivot about the second hinge 126 and open the second air passing hole 120, and is discharged into the place being cleaned through the second air passing hole. As a result, a clean place in a pleasant atmosphere can be provided.

As the cleaner stops cleaning, air is not discharged through the discharge port 211*a* any more. Referring to FIG. 4B, air does not flow to the first air passing hole 110, so that the inner cover member 115 is pivoted about the second hinge 126 by its own weight and closes the second air passing hole 120. Because the housing 101 including the air freshener 140 is isolated from the outside, fragrant odor is not dissipated when the vacuum cleaner is not in operation.

As explained above, discharged air pushes the inner and outer cover members 115, 125 to pivot and to accordingly open the first and second air passing holes 110, 120 so that air is discharged along with the fragrant agent. When the vacuum cleaner is not in operation, the inner and outer cover members 115, 125 are pivoted by their own weights and close the first and second air passing holes 110, 120, so that the interior of the housing 101 is isolated from outside and the discharge port 211*a*. Because agent does not dissipate from the air freshener 140 when the vacuum cleaner is not in operation, the air freshener can be used for a longer period of time.

In an exemplary embodiment of the present disclosure, the housing 101 is detachably engaged with the grill member 211 of the main cleaner body 210 by the interlocking of the hooking projection 104*a* and the extension projection 104*b*. Accordingly, if the air freshener 140 is not used for a while, it may be removed from the main cleaner body 210 and stowed in a sealed place. Because the main housing body 101*a* and the housing cover 101*b* are engaged with each other by the interlocking of the simple structure of the engagement projection 105 and the engagement hole 103, a user may easily open the housing cover 101*b* from the main housing body 101*a* and remove or replace the air freshener 140.

Figure 5:
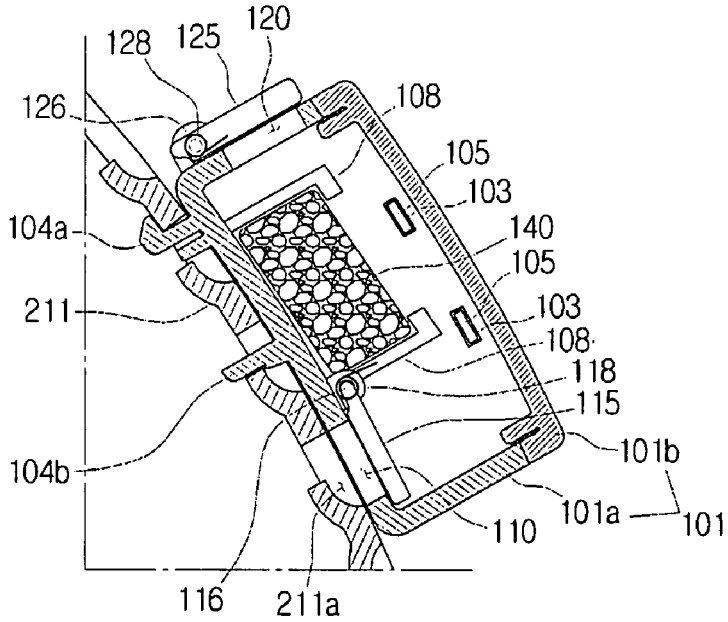
FIG. 5 is a view illustrating the structure in which first and second springs are disposed at first and second hinge parts.

In an exemplary embodiment of the present disclosure, the inner and outer cover members 115, 125 are pivoted by their own weights to close the first and second air passing holes 110, 120. An alternative example is also possible as illustrated in FIG. 5, in which a first spring 118 is disposed at the first hinge 116 to elastically bias the inner cover member 115 towards a direction of closing the first air passing hole 110, and a second spring 128 is disposed at the second hinge 126 to elastically bias the outer cover member 125 towards a direction of closing the second air passing hole 120. The first and second springs 118, 128 have a predetermined elasticity so as to cause the inner and outer cover members 115, 125 to be pivoted by the flow of discharged air from the discharge port 211*a* to a direction of opening the first and second air passing holes 110, 120 when the vacuum cleaner is in operation, while causing the inner and outer cover members 115, 125 to be pivoted to a direction of closing the first and second air passing holes 110, 120 when the vacuum cleaner is not in operation and no air is discharged from the discharge port 211*a*.

Figure 6:
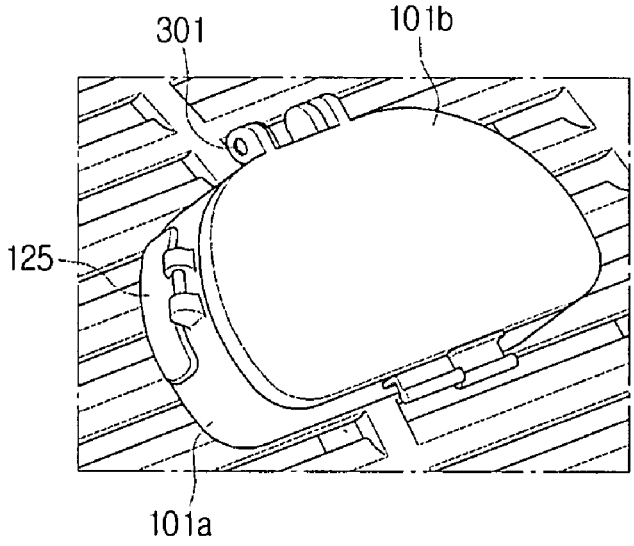
FIG. 6 illustrates a housing cover and a housing body engaged with each other, and installation of an external cover member, according to another exemplary embodiment of the present disclosure.
Figure 7:
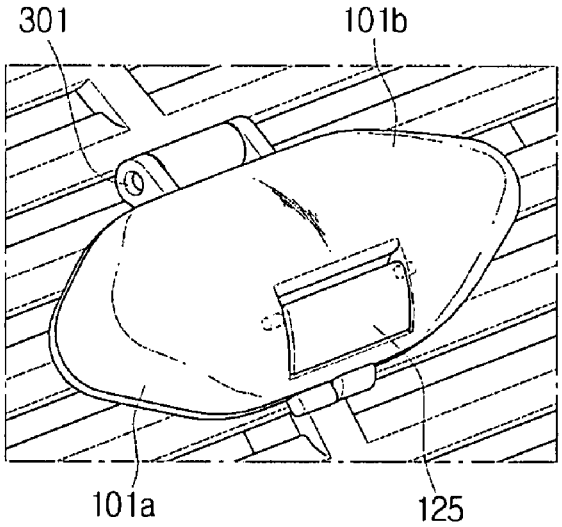
FIG. 7 illustrates the installation of an external cover member according to yet another exemplary embodiment of the present disclosure.

In an exemplary embodiment of the present disclosure, the outer cover member 125 is mounted to the outer surface of the upper portion of the main housing body 101*a*. An alternative example is also possible as illustrated in FIG. 6, in which the outer cover member 125 us mounted to the side of the main housing body 101*a*. Another alternative example is possible as illustrated in FIG. 7, in which the outer cover member 125 is mounted to the housing cover 101*b*.

In an exemplary embodiment of the present disclosure, the housing cover 101*b* and the main housing body 101*a* are detachably engaged with each other by the interlocking of the engagement projection 105 and the engagement hole 103, and therefore it is easy to replace the air freshener 140. In an alternative example as illustrated in FIG. 6, the housing cover 101*b* may be pivoted about a hinge axis 301, to open a side of the main housing body 101*a*, and the air freshener 140 is removed from the open side.

As explained above, with a vacuum cleaner having a fragrant odor generating apparatus according to the exemplary embodiments of the present disclosure, fragrant odor is dissipated throughout the place being cleaned when the vacuum cleaner is in operation, by the simple structure including a housing having a first and second air passing holes, an inner cover member and an outer cover member. The housing including the fragrant odor generating apparatus is then isolated from the outside and from the main cleaner body so that fragrant odor is not dissipated when the vacuum cleaner is not in operation. As a result, an air freshener can be used for a prolonged period of time.

Furthermore, because the first and second air passing holes can be closed by the weights of the inner and outer cover members, the fragrant odor generating apparatus can have simple structure and does not require separate power.

Furthermore, because the fragrant odor generating apparatus can be removably mounted to the outer surface of the discharge grill of the vacuum cleaner, mounting and demounting the air freshener to and from the fragrant odor generating apparatus is convenient.

Although a few exemplary embodiments of the present disclosure have been shown and described, it would be appreciated by those skilled in the art that changes may be made in these exemplary embodiments without departing from the principles and spirit of the disclosure, the scope of which is defined in the claims and their equivalents.

What is claimed is:

1. A vacuum cleaner comprising:

a fragrant odor generating apparatus mounted to a discharge port of a grill member housed in a main cleaner body, to discharge an air freshener to an air being discharged through the discharge port after air containing dust is drawn in from a surface being cleaned and dust is separated from the drawn-in air, the fragrant odor generating apparatus comprising, a housing comprising a first air passing hole in fluid communication with the discharge port, and a second air passing hole in fluid communication with outside, an outer cover member pivotably mounted to the housing to selectively open and close the second air passing hole, and the air freshener containing a fragrant agent, and mounted inside the housing, wherein if the vacuum cleaner is driven and air is discharged through the discharge port, the discharged air past through the discharge port and the first air passing hole pushes the outer cover member to a direction of opening the second air passing hole, so that the discharged air containing the fragrant agent is passed through the second air passing hole and discharged to outside, and if the vacuum cleaner is not driven and air is not discharged through the discharge port, the outer cover member is moved to a direction of closing the second air passing hole by its own weight.

2. The vacuum cleaner of claim 1, wherein the fragrant odor generating apparatus further comprises an inner cover member pivotably mounted on the housing to selectively open and close the first air passing hole, so that if the vacuum cleaner is driven and air is discharged through the discharge port, the discharged air causes the inner cover member to pivot to a direction of opening the first air passing hole, and if the vacuum cleaner is not driven and air is not discharged through the discharge port, the inner cover member is moved by its own weight to a direction of closing the first air passing hole.

3. The vacuum cleaner of claim 2, further comprising a first elastic member to elastically bias the inner cover member to a direction of closing the first air passing hole, and a second elastic member to elastically bias the outer cover member to a direction of closing the second air passing hole, and wherein the inner cover member and the outer cover member are pivoted by the force of the air discharged through the discharge port, to open the first and second air passing holes, and if the vacuum cleaner stops operation and air is not discharged through the discharge port any more, the inner cover member and the outer cover member are pivoted by the first and second elastic members to a direction of closing the first and second air passing holes.

4. The vacuum cleaner of claim 1, wherein the housing comprises a main housing body having one side open, the air freshener removably mounted therein, and a plurality of engagement holes formed therein; and a housing cover having a plurality of engagement projections corresponding to the plurality of engagement holes, the housing cover being engaged by interlocking of the plurality of engagement projections and the plurality of engagement holes to cover the open side of the main housing body.

5. The vacuum cleaner of claim 4, wherein the outer cover member is mounted to an upper surface of the main housing body.

6. The vacuum cleaner of claim 4, wherein the outer cover member is mounted to a side surface of the main housing body.

7. The vacuum cleaner of claim 4, wherein the outer cover member is mounted to the housing cover.

8. The vacuum cleaner of claim 1, wherein the housing comprises:

a main housing body having one side open, and the air freshener removably mounted inside the main housing body; and a housing cover pivotably mounted to the main housing body, to selectively open and close the open side of the main housing body.

9. The vacuum cleaner of claim 8, wherein the outer cover member is mounted to an upper surface of the main housing body.

10. The vacuum cleaner of claim 8, wherein the outer cover member is mounted to a side surface of the main housing body.

11. The vacuum cleaner of claim 8, wherein the outer cover member is mounted to the housing cover.

12. A vacuum cleaner comprising:

a main cleaner body being configured to draw air containing dust from a surface being cleaned, to separate dust from the drawn air, and to discharge clean air through a discharge port;

a housing having a first air passing hole, an inside area, and a second air passing hole, the first air passing hole being in fluid communication with the discharge port and the inside area, the second air passing hole being in fluid communication with the inside area and an area outside the main cleaner body;

an air freshener removably mounted in the inside area of the housing; and an outer cover member pivotably mounted to the housing to selectively open the second air passing hole when the clean air is discharged through the discharge port and selectively close the second air passing hole when the clean air is not discharged through the discharge port, wherein the outer cover member selectively closes the second air passing hole by its own weight when the clean air is not discharged through the discharge port.

13. The vacuum cleaner of claim 12, further comprising an outer elastic member configured to selectively close the outer cover member when the clean air is not discharged through the discharge port, the outer elastic member being selectively opened by the force of the clean air when the clean air is discharged through the discharge port.

14. A vacuum cleaner comprising:

a main cleaner body being configured to draw air containing dust from a surface being cleaned, to separate dust from the drawn air, and to discharge clean air through a discharge port;

a housing having a first air passing hole, an inside area, and a second air passing hole, the first air passing hole being in fluid communication with the discharge port and the inside area, the second air passing hole being in fluid communication with the inside area and an area outside the main cleaner body;

an air freshener removably mounted in the inside area of the housing;

an outer cover member pivotably mounted to the housing to selectively open the second air passing hole when the clean air is discharged through the discharge port and selectively close the second air passing hole when the clean air is not discharged through the discharge port; and an inner cover member pivotably mounted to the housing to selectively open the first air passing hole when the clean air is discharged through the discharge port and selectively close the first air passing hole when the clean air is not discharged through the discharge port.

15. The vacuum cleaner of claim 14, wherein the inner cover member selectively closes the first air passing hole by its own weight when the clean air is not discharged through the discharge port.

16. The vacuum cleaner of claim 14, further comprising an inner elastic member configured to selectively close the inner cover member when the clean air is not discharged through the discharge port, the inner elastic member being selectively opened by the force of the clean air when the clean air is discharged through the discharge port.

* * * * *